US009216313B1

(12) United States Patent
Wu

(10) Patent No.: US 9,216,313 B1
(45) Date of Patent: Dec. 22, 2015

(54) ELASTIC CORD FOR A PULL EXERCISER

(71) Applicant: Yung-Cheng Wu, Tainan (TW)

(72) Inventor: Yung-Cheng Wu, Tainan (TW)

( * ) Notice: Subject to any disclaimer, the term of this patent is extended or adjusted under 35 U.S.C. 154(b) by 25 days.

(21) Appl. No.: 14/340,663

(22) Filed: Jul. 25, 2014

(51) Int. Cl.
*A63B 21/055* (2006.01)
*A63B 23/12* (2006.01)
*A63B 21/00* (2006.01)

(52) U.S. Cl.
CPC ..... *A63B 21/0555* (2013.01); *A63B 21/1469* (2013.01); *A63B 23/1209* (2013.01)

(58) Field of Classification Search
CPC ..... A63B 21/02; A63B 21/026; A63B 21/05; A63B 21/055–21/0557; A61M 2039/082; A61M 2025/004
See application file for complete search history.

(56) References Cited

U.S. PATENT DOCUMENTS

| | | | | |
|---|---|---|---|---|
| 1,686,424 | A | 10/1928 | Thomson et al. | 24/136 R |
| 2,590,951 | A | 4/1952 | Sumner | 482/126 |
| 2,865,978 | A | 12/1958 | Modrey | 174/69 |
| 3,584,606 | A | 6/1971 | Reidhead | 119/805 |
| 3,589,721 | A | 6/1971 | Cronauer | 482/125 |
| 3,857,645 | A | 12/1974 | Klein | 403/206 |
| 5,221,256 | A * | 6/1993 | Mahurkar | A61M 25/0026 604/43 |
| 5,356,681 | A | 10/1994 | Ichikawa et al. | 428/36.8 |
| 5,546,639 | A | 8/1996 | Lacore et al. | 24/265 H |
| 5,800,322 | A | 9/1998 | Block | 482/126 |
| 6,202,263 | B1 | 3/2001 | Harker | 24/300 |
| 6,508,749 | B1 | 1/2003 | Broadwater | 482/121 |
| 6,676,576 | B1 | 1/2004 | Wu | 482/126 |
| 7,326,157 | B2 | 2/2008 | Wu | 482/126 |
| 7,357,762 | B1 | 4/2008 | Terry et al. | 482/126 |
| 7,377,886 | B2 | 5/2008 | Wu | 482/126 |
| 7,448,990 | B2 | 11/2008 | Wu | 482/121 |
| 7,455,632 | B2 | 11/2008 | Block et al. | 482/126 |
| 7,458,135 | B2 | 12/2008 | Mikesell et al. | 24/300 |
| 7,503,883 | B2 | 3/2009 | Madden | 482/126 |
| 2004/0097345 | A1 | 5/2004 | O'Shea | 482/82 |
| 2005/0075223 | A1 | 4/2005 | Wu | 482/126 |
| 2005/0113222 | A1 | 5/2005 | Dovner et al. | 482/121 |
| 2005/0137066 | A1 | 6/2005 | Wu | 482/126 |
| 2005/0176562 | A1 | 8/2005 | Huang | 482/121 |
| 2006/0073954 | A1 | 4/2006 | Block et al. | 482/121 |
| 2007/0015643 | A1 | 1/2007 | Kung | 482/126 |
| 2007/0042881 | A1 | 2/2007 | Wu | 482/126 |
| 2007/0155600 | A1 | 7/2007 | Cunningham et al. | 482/126 |
| 2007/0173387 | A1 | 7/2007 | Wu | 482/121 |
| 2007/0207904 | A1 | 9/2007 | Wu | 482/126 |
| 2008/0214370 | A1 | 9/2008 | Terry et al. | 482/126 |
| 2009/0176634 | A1 | 7/2009 | Wu | 482/122 |
| 2010/0216613 | A1 * | 8/2010 | Pacini | A63B 21/0552 482/122 |

* cited by examiner

*Primary Examiner* — Loan H Thanh
*Assistant Examiner* — Jennifer M Deichl
(74) *Attorney, Agent, or Firm* — Alan D. Kamrath; Kamrath IP Lawfirm, P.A.

(57) ABSTRACT

An elastic cord includes a hollow outer elastic cord having a first end and a second end spaced from the first end in a longitudinal direction. The hollow outer elastic cord further includes an outer periphery and an inner periphery spaced from the outer periphery in a radial direction perpendicular to the longitudinal direction. A rib extends from the inner periphery. The rib extends from the first end through the second end of the hollow outer elastic rod. The rib includes a longitudinal hole extending from the first end through the second end of the hollow outer elastic cord. An elastic string is received in the longitudinal hole of the rib. The elastic string includes two ends respectively located in the first and second ends of the hollow outer elastic cord. The elastic string has a maximal elongation larger than a maximal elongation of the hollow outer elastic cord.

5 Claims, 7 Drawing Sheets

ELASTIC CORD FOR A PULL EXERCISER

BACKGROUND OF THE INVENTION

The present invention relates to an elastic cord and, more particularly, to an elastic cord for a pull exerciser avoiding injury to a user when the elastic cord is broken during use.

Pull exercisers utilizing elastic cords allow exercise of muscles of the breast and arms of a user. These pull exercisers are light, small, and easy to carry and are, thus, a preferred option to modern people.

A typical elastic cord of a pull exerciser is hollow and attached between two handles. An exercise effect in the muscles of the breast and arms of a user can be attained when the user holding the handles repeatedly stretches and releases the elastic cords. However, with reference to FIG. 1, when a user 1 holds the handles 101 of a conventional pull exerciser 10 and stretches the elastic cord 102, the elastic cord 102 could break and injure the user 1.

Thus, a need exists for an improved elastic cord for an exerciser that would not injure the user when it breaks during use.

BRIEF SUMMARY OF THE INVENTION

An elastic cord according to the present invention includes a hollow outer elastic cord having a first end and a second end spaced from the first end in a longitudinal direction. The hollow outer elastic cord further includes an outer periphery and an inner periphery spaced from the outer periphery in a radial direction perpendicular to the longitudinal direction. A rib extends from the inner periphery. The rib extends from the first end through the second end of the hollow outer elastic rod. The rib includes a longitudinal hole extending from the first end through the second end of the hollow outer elastic cord. An elastic string is received in the longitudinal hole of the rib. The elastic string includes two ends respectively located in the first and second ends of the hollow outer elastic cord. The elastic string has a maximal elongation larger than a maximal elongation of the hollow outer elastic cord.

The rib can further include two lateral sides opposite to each other. Each of the two lateral sides extends between the first and second ends of the rib. A ratio of a spacing between the two lateral sides of the rib to a spacing between the inner periphery and the outer periphery of the hollow outer elastic cord is in a range between 1.5:1 and 4:1.

In an example, a first end and a second end of the rib are connected to the inner periphery of the hollow outer elastic cord.

The rib can further include an enlarged portion between the first end and the second end of the rib.

In another example, a first end of the rib is connected to the inner periphery of the hollow outer elastic cord, and a second end of the rib is spaced from the inner periphery of the hollow outer elastic cord.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
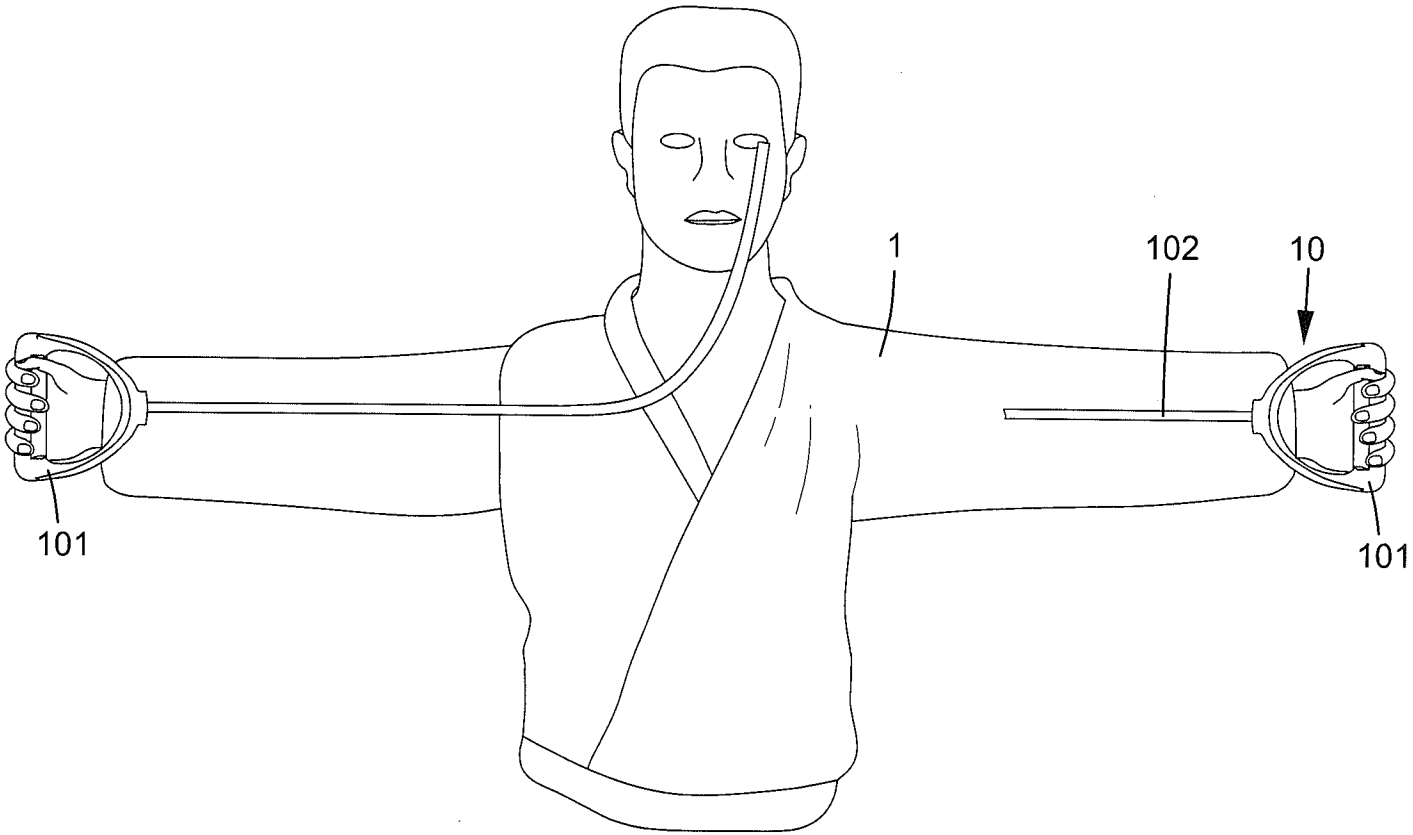
FIG. 1 is a schematic view of a user and a conventional pull exerciser with an elastic cord of the pull exerciser broken during use.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "side", "end", "portion", "longitudinal", "radial", "lateral", "spacing", "length", "width", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

An elastic cord of a first embodiment according to the present invention is shown in FIGS. 2-5 of the drawings and generally designated 14. In an example shown in FIG. 2, the elastic cord 14 is utilized with a pull exerciser 12 of the type including two handles 38. Each end of the elastic rod 14 is knotted after extending through a through-hole 40 of one of the handles 38 to prevent the elastic cord 14 from disengaging from the through-hole 40.

With reference to FIGS. 2-5, the elastic cord 14 of the first embodiment includes a hollow outer elastic cord 20 that is elongated and that can be formed by extruding thermoplastic rubber (TPR). The hollow outer elastic cord 20 can be repeatedly stretched with a force and can restore its original length after the force is released. The hollow outer elastic cord 20 includes a first end 22 and a second end 24 spaced from the first end 22 in a longitudinal direction. The hollow outer elastic cord 20 further includes an outer periphery 26 and an inner periphery 28 spaced from the outer periphery 26 in a radial direction perpendicular to the longitudinal direction.

Figure 2:
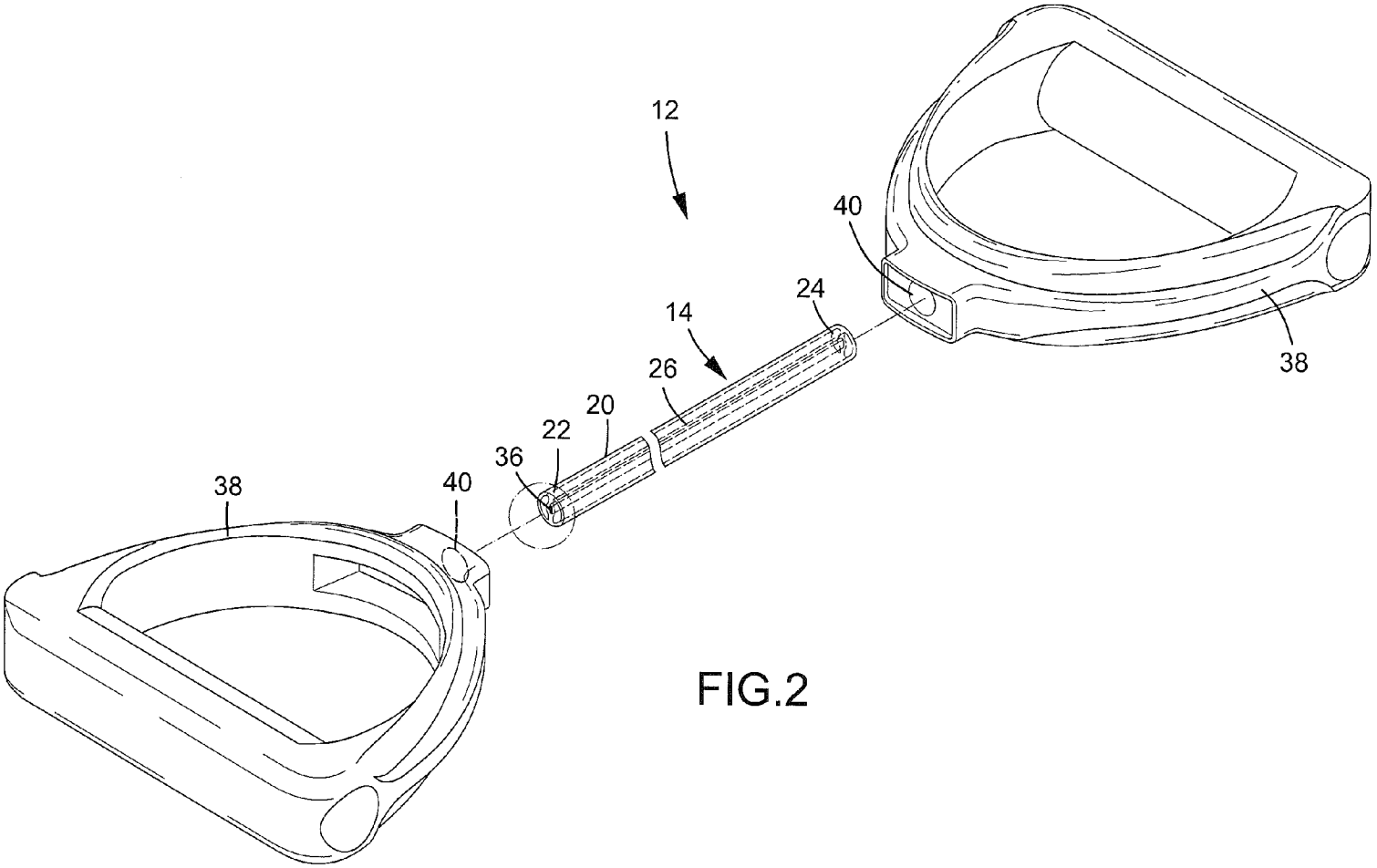
FIG. 2 is an exploded, perspective view of a pull exerciser utilizing an elastic cord of a first embodiment according to the present invention.
Figure 2A:
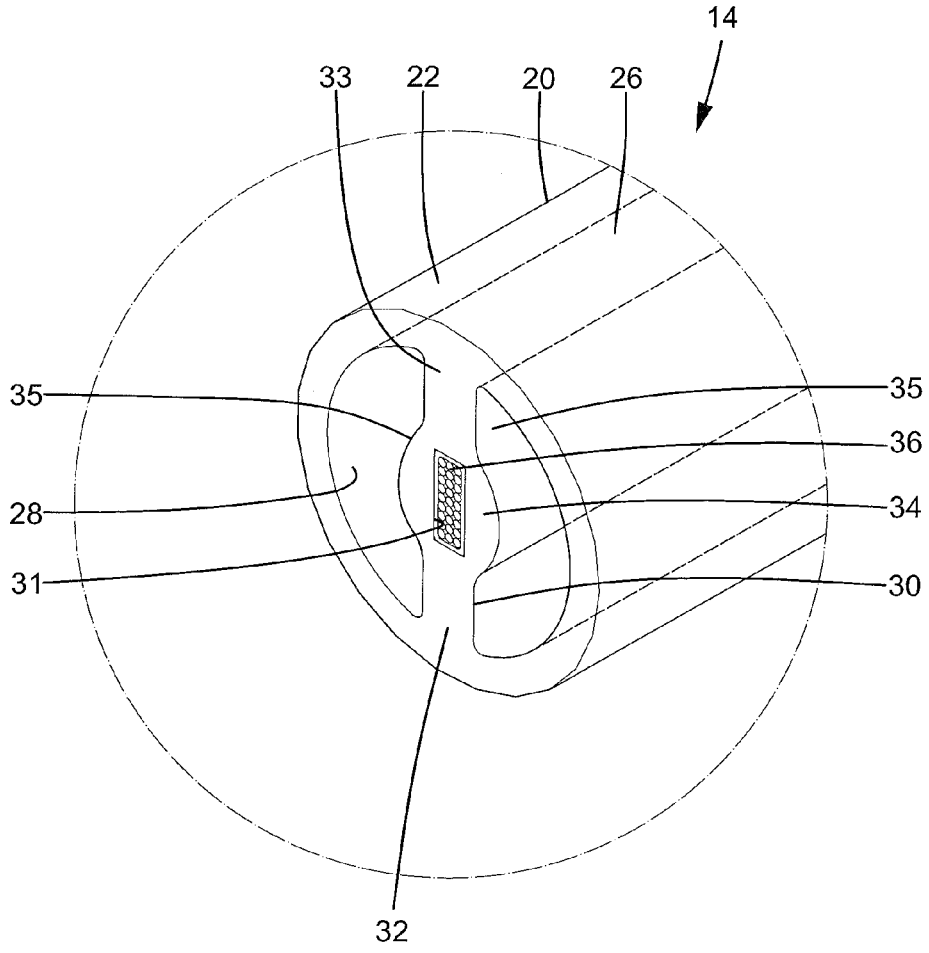
FIG. 2A is an enlarged view of a circled portion of FIG. 2.
Figure 3:
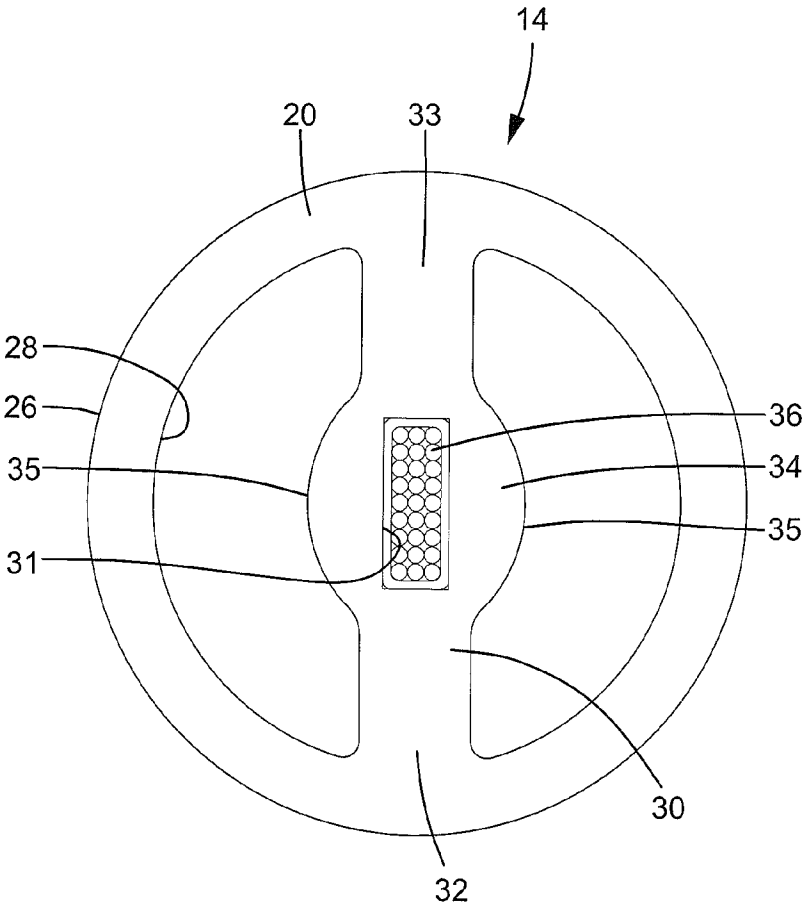
FIG. 3 is a side view of the elastic cord of FIG. 2.
Figure 4:
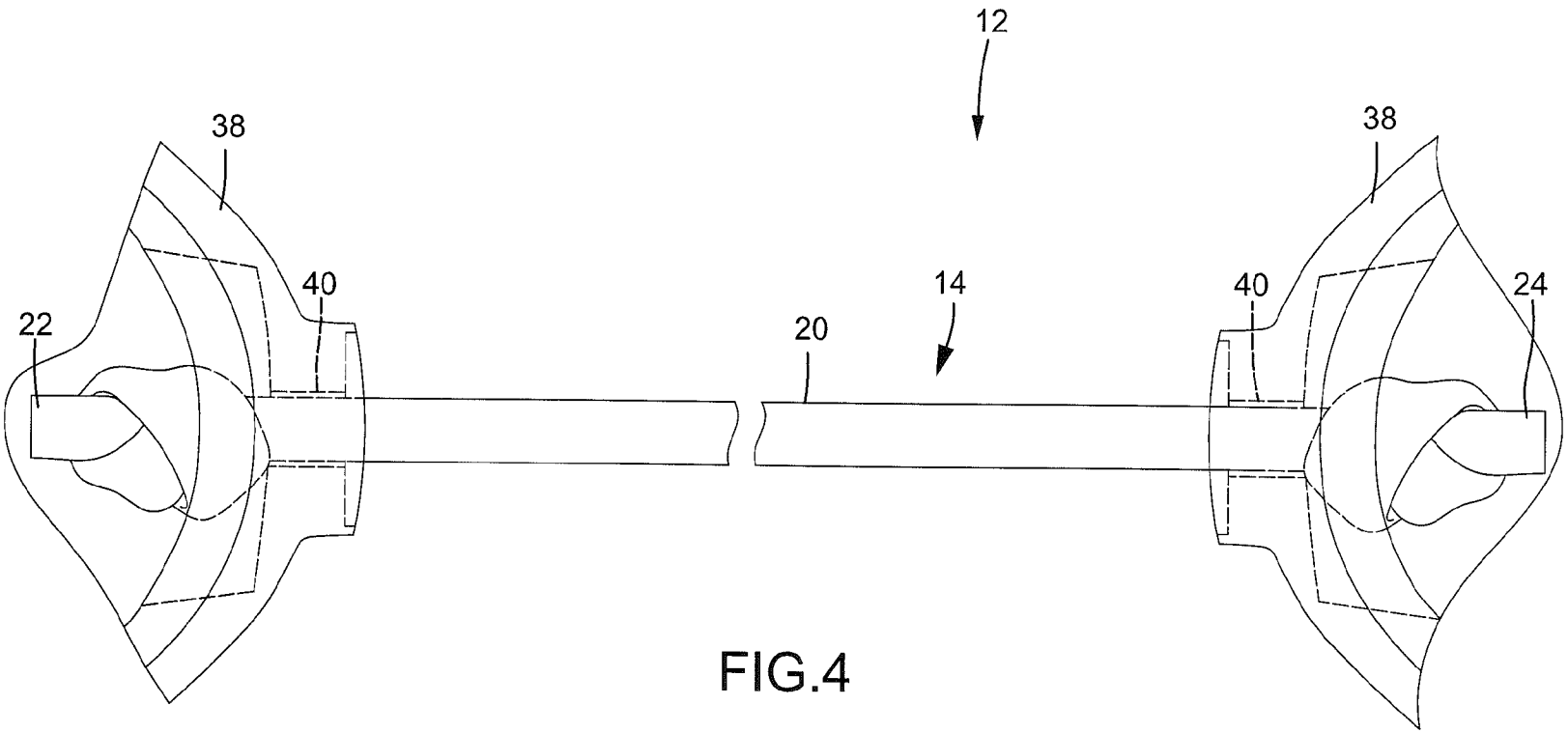
FIG. 4 is a partial, perspective view of the pull exerciser utilizing the elastic cord of FIG. 2.
Figure 5:
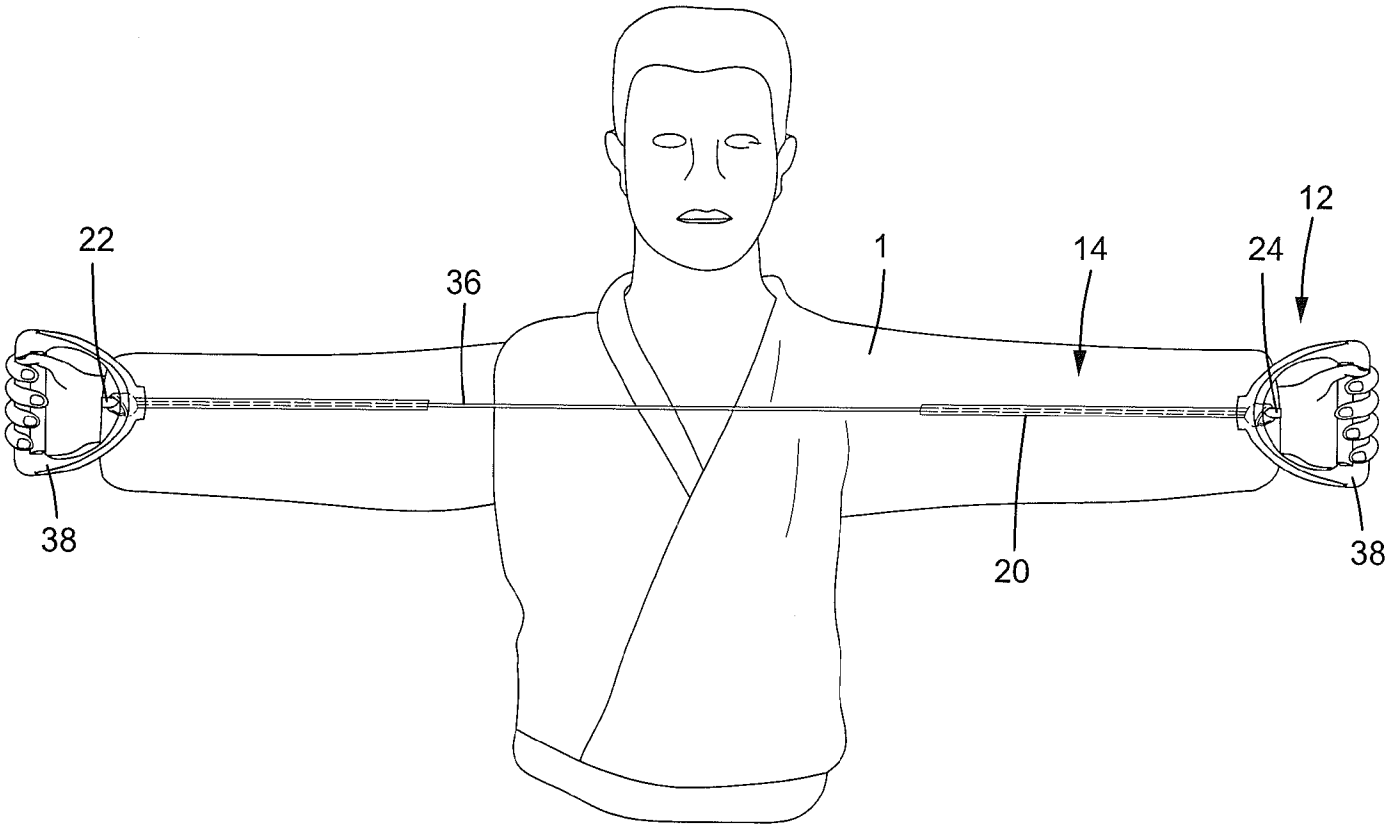
FIG. 5 is a schematic view of a user utilizing the pull exerciser of FIG. 2 with the elastic cord broken during use.

A rib 30 extends from the inner periphery 28. The rib 30 extends from the first end 22 through the second end 24 of the hollow outer elastic rod 20. The rib 30 includes a first end 32 and a second end 33. The first end 32 and the second end 33 of the rib 30 are connected to the inner periphery 28 of the hollow outer elastic cord 20. The rib 30 further includes two lateral sides 35 opposite to each other. Each lateral side 35 extends between the first and second ends 32 and 33 of the rib 30. The rib 30 further includes an enlarged portion 34 between the first end 32 and the second end 33 of the rib 30. Furthermore, the rib 30 includes a longitudinal hole 31 extending from the first end 22 through the second end 24 of the hollow outer elastic cord 20 (see FIGS. 2A and 3). The rib 30 separates an interior of the hollow outer elastic cord 20 into two portions. A ratio of a spacing between the two lateral sides 35 of the rib 30 to a spacing between the inner periphery 28 and the outer periphery 26 of the hollow outer elastic cord 20 is in a range between 1.5:1 and 4:1. Namely, the thickness of the rib 30 in the middle of the hollow outer elastic cord 20 is larger than the thickness of the peripheral portion of the hollow outer elastic cord 20.

With reference to FIGS. 2-5, the elastic cord 14 further includes an elastic string 36 that can be repeatedly stretched by a force and that can store its original length after the force is released. The elastic string 36 is received in the longitudinal hole 31 of the rib 30. In practice, the elastic string 36 is enclosed by the rib 30 while the hollow outer elastic cord 20 is formed by extrusion. Thus, the elastic string 36 is received in the longitudinal hole 31. A length of the unstretched elastic string 36 is substantially the same as a length of the unstretched hollow outer elastic cord 20. Thus, the two ends of the elastic string 36 are flush with end faces of the first and second ends 22 and 24 of the hollow outer elastic cord 20. Furthermore, the maximal elongation of the elastic string 36 is different from the maximal elongation of the hollow outer elastic cord 20. The maximal elongation is the elongation of the hollow outer elastic cord 20 or elastic string 36 stretched to a nearly broken state. The maximal elongation of the elastic string 36 is larger than the maximal elongation of the hollow outer elastic cord 20. Since two ends of the elastic cord 14 are respectively connected to two handles 38, the stretched lengths of the hollow outer elastic cord 20 and the elastic string 36 are identical when the handles 38 are operated to stretch the elastic cord 14.

If the hollow outer elastic cord 20 breaks while the user holds the handles 38 of the pull exerciser 12 and stretches the elastic cord 14, the elastic string 36 is still in a stretched state because the maximal elongation of the elastic string 36 is larger than the maximal elongation of the hollow outer elastic cord 20. Namely, the elastic string 36 is not broken when the hollow outer elastic cord 20 breaks (see FIG. 5). Thus, the broken hollow outer elastic cord 20 is retrained by the elastic string 36 and, thus, would not injure the user.

Thus, when the hollow outer elastic cord 20 of elastic cord 14 of any type breaks in an unexpected situation, the elastic string 36 is still stretchable without breakage. As a result, the hollow outer elastic cord 20 can be restrained by the elastic string 36 such that the hollow outer elastic cord 20 can only move towards the handles 38 together with the elastic string 36 without injuring the user.

The thickness of the rib 30 in the middle of the hollow outer elastic cord 20 is larger than the thickness of the peripheral portion of the hollow outer elastic cord 20. Thus, the middle portion of the hollow outer elastic cord 20 is less likely to break. Furthermore, since the rib 30 completely encloses the elastic string 36, the elastic string 36 is reliably positioned in relation to the inner periphery 28 of the hollow outer elastic cord 20. During stretching and releasing of the elastic cord 14, frequent contact and friction between the elastic string 36 and the inner periphery 28 of the hollow outer elastic cord 20 can be avoided. Thus, the possibility of breakage of the hollow outer elastic cord 20 during operation is reduced.

Figure 6:
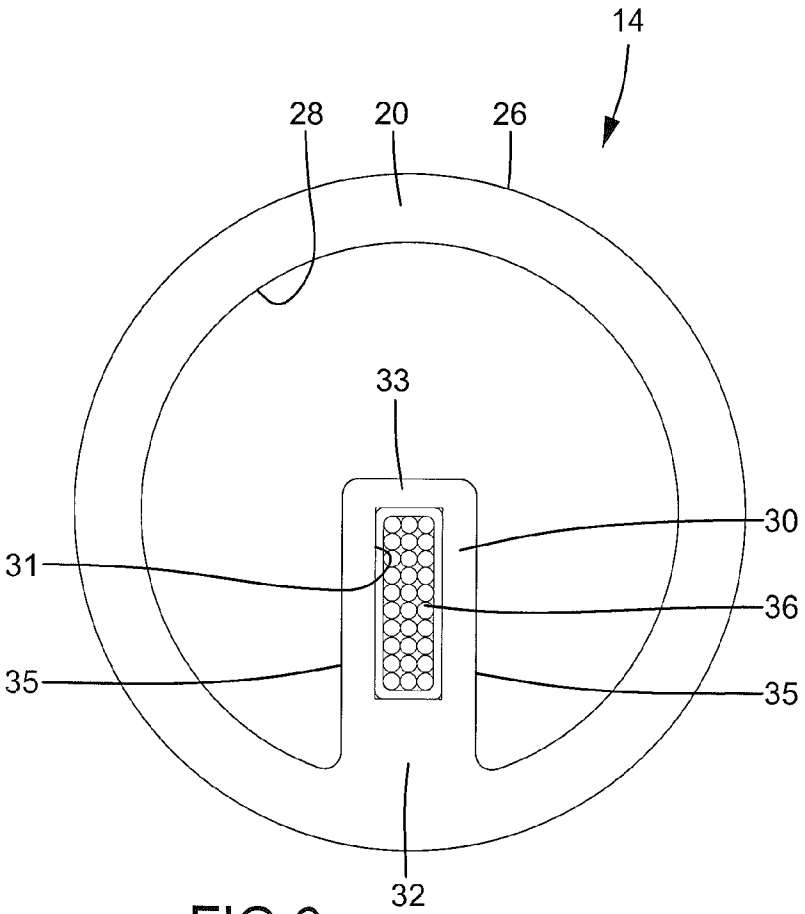
FIG. 6 is a side view of an elastic cord of a second embodiment according to the present invention.

FIG. 6 shows an elastic cord 14 of a second embodiment according to the present invention. In this embodiment, the first end 32 of the rib 30 is connected to the inner periphery 28 of the hollow outer elastic cord 20, and the second end 33 of the rib 30 is spaced from the inner periphery 28 of the hollow outer elastic cord 20. When the hollow outer elastic cord 20 beaks, the elastic cord 14 can still avoids injury to the user by the elastic string 36.

Now that the basic teachings have been explained, many extensions and variations will be obvious to one having ordinary skill in the art. For example, the elastic string 36 can be made of thermoplastic rubber or other elastic materials as long as the maximal elongation of the elastic string 36 is larger than that of the hollow outer elastic cord 20. Furthermore, the rib 30 does not have to include the enlarged portion 34. The elastic string 36 can be received in the rib 30 if the width of the rib 30 is still larger than the width of the elastic string 36. Furthermore, an end of the elastic cord 14 can be fixed to a wall or a floor, and the other end of the elastic cord 14 can be coupled to a handle 38 for stretching. Furthermore, the elastic cord 14 can be utilized with pull exercisers of other types.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An elastic cord comprising:

a hollow outer elastic cord including a first end and a second end spaced from the first end in a longitudinal direction, with the hollow outer elastic cord further including an outer periphery and an inner periphery spaced from the outer periphery in a radial direction perpendicular to the longitudinal direction, with a rib extending from the inner periphery, with the rib extending from the first end through the second end of the hollow outer elastic cord, and with the rib including a longitudinal hole extending from the first end through the second end of the hollow outer elastic cord; and an elastic string received in the longitudinal hole of the rib, with the elastic string including two ends respectively located in the first and second ends of the hollow outer elastic cord, and with the elastic string having a maximal elongation larger than a maximal elongation of the hollow outer elastic cord.

2. The elastic cord as claimed in claim 1, with the rib further including two lateral sides opposite to each other, with each of the two lateral sides extending between the first and second ends of the rib, and with a ratio of a spacing between the two lateral sides of the rib to a spacing between the inner periphery and the outer periphery of the hollow outer elastic cord being in a range between 1.5:1 and 4:1.

3. The elastic cord as claimed in claim 1, with the rib including a first end and a second end, and with the first end and the second end of the rib connected to the inner periphery of the hollow outer elastic cord.

4. The elastic cord as claimed in claim 3, with the rib further including an enlarged portion between the first end and the second end of the rib.

5. The elastic cord as claimed in claim 1, with the rib including a first end and a second end, with the first end of the rib connected to the inner periphery of the hollow outer elastic cord, and with the second end of the rib spaced from the inner periphery of the hollow outer elastic cord.

* * * * *